United States Patent [19]

Bailey

[11] 4,095,783

[45] Jun. 20, 1978

[54] APPARATUS FOR CREATING AN ILLUSION

[76] Inventor: Steven R. Bailey, R.R. 1, Prole, Iowa 50229

[21] Appl. No.: 728,635

[22] Filed: Oct. 1, 1976

[51] Int. Cl.[2] ..... A63J 21/00

[52] U.S. Cl. ..... 272/8 R

[58] Field of Search ..... 272/9, 21, 25, 8 R, 272/8 D, 8 F, 8 M, 8 N, 8 P, 27 R, 27 B, 27 W, 27 N; 46/1 L, 11; 273/144 B, 144 R, 144 A, 145 B, 145 C, 145 E

[56] References Cited

FOREIGN PATENT DOCUMENTS

| | | | |
|---|---|---|---|
| 1,077,300 | 4/1954 | France | 273/144 B |
| 1,383,479 | 11/1964 | France | 273/145 C |
| 340,271 | 9/1921 | Germany | 272/8 R |
| 480,550 | 2/1938 | United Kingdom | 273/145 C |

*Primary Examiner*—Richard C. Pinkham
*Assistant Examiner*—Arnold W. Kramer
*Attorney, Agent, or Firm*—Henderson, Strom & Sturm

[57] ABSTRACT

An apparatus for creating an illusion that a die has disappeared including a housing pivotally attached to a base member. The housing has an internal chamber and three doors formed on each side thereof leading from the exterior of the housing to the chamber. Doors are provided on the openings adjacent the ends of the housing for selectively closing or opening these openings. A collapsible die is provided for being selectively receivable into the housing, and is movable from an uncollapsed to a collapsed position for creating the illusion that the die has disappeared within the housing.

2 Claims, 9 Drawing Figures

APPARATUS FOR CREATING AN ILLUSION

BACKGROUND OF THE INVENTION

The present invention relates generally to an apparatus for use by magicians and particularly to an apparatus for creating the illusion that a die has disappeared.

In the entertainment field, magicians perform various tricks, many of which relate to making things mysteriously appear or disappear. In such displays of magic, the same types of tricks are often seen time and time again. Consequently, there is a continuing need for new and different illusion creating devices in order to keep this phase of the entertainment business interesting and entertaining.

SUMMARY OF THE INVENTION

The present invention relates to an apparatus for creating an illusion that an object has disappeared. A housing is provided having a chamber therein and at least one opening disposed in the housing and leading from the exterior of the housing to the chamber for permitting visual access to the chamber. In its simplest form, the invention relates to such housing in combination with a device which appears to be in the shape of a solid parallelepiped, but which in fact is only partially of such shape and which has a front wall which is pivotally movable from a position wherein it is clearly visually conspicuous to a folded position wherein it is substantially unperceivable from a distance.

Other aspects of the invention relate to the housing in combination with the above, whereby centrally located openings in the housing make is visually apparent that the object is in the housing by moving the object from one end to the other end past the central openings. Additionally, doors are provided on the openings adjacent the ends of the housing, and the housing is furthermore pivotally attached to a base to facilitate moving the object from one end to the other and to facilitate making the trick as dramatic as possible.

An object of the present invention is to provide a novel apparatus for creating an illusion of making an object such as a die disappear.

Other objects, advantages and novel features of the present invention will become apparent from the following detailed description of the invention when considered in conjunction with the accompanying drawings.

DESCRIPTION OF THE PREFERRED EMBODIMENT

Figure 1:
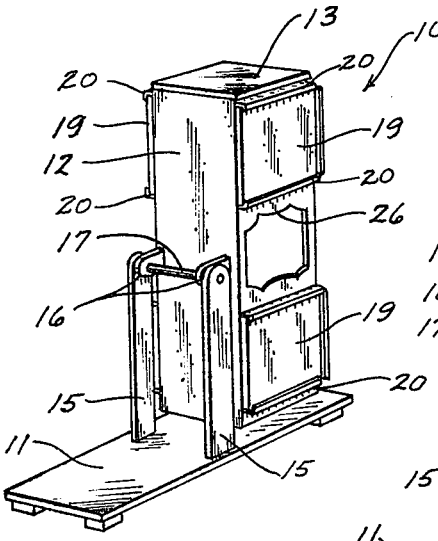
FIG. 1 is a perspective view of a preferred embodiment of the present invention.

Referring now to the drawings wherein like reference numerals designate identical or corresponding parts throughout the several views, FIG. 1 shows an apparatus 10 constructed in accordance with the present invention. The invention 10 includes a base member 11 and a housing 12 pivotally attached to the base 11. A cover 13 is removably attached to one end of the housing 12 and is removable to insert or remove a collapsible die 14, which collapsible die 14 is illustrated in detail in FIGS. 7–9.

Two upstanding posts 15 are rigidly attached to the base 11, but it is to be understood that other structures such as one solid upstanding post is equivalent thereto. A pair of projecting members 16 are rigidly attached to the middle of one side of the housing 12 to facilitate pivotally attaching the housing 12 to the post members 15. A pin 17 is provided to complete the pivotal attachment, and this pin 17 extends through openings in the ends of the projections 16 and into the ends of the upstanding post members 15. The housing 12 has three openings in each side thereof, and one end opening which is selectively closable by the door 13.

Figure 4:
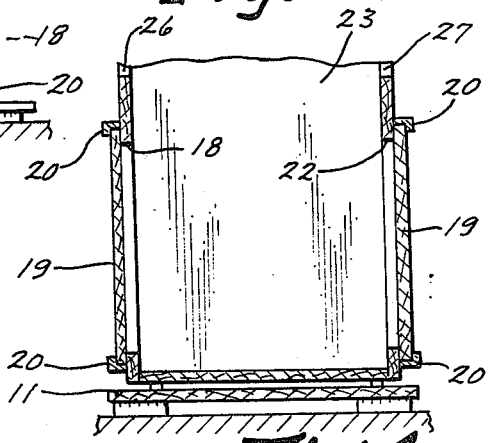
FIG. 4 is a partial cross-sectional view taken along line 4—4 of FIG. 2.
Figure 5:
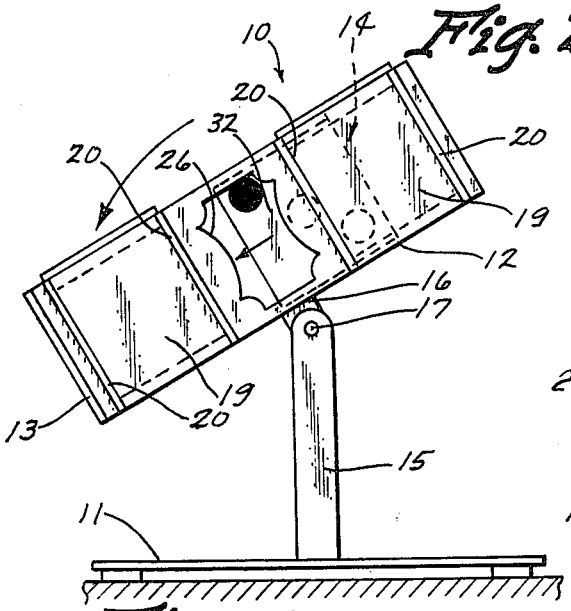
FIG. 5 is a side elevational view similar to the view of FIG. 2, but showing the device in a position moving between its two extreme positions.

Referring to FIG. 4, a first opening 18 is shown. This opening 18 is selectively opened or closed by a door 19 which merely is slidably receivable within channels formed by members 20 which are rigidly attached to the housing 12. One end 21 of the door 19 is enlarged for enhancing the ease with which the door 19 may be removed or put back in place.

Referring again to FIG. 4, a second opening 22 is formed on the other side of the housing 12 from the first opening 18 in general alignment with the opening 18 so that the person can see through from opening 18, through the chamber 23 and out the back and second opening 22 when the doors of these openings are removed. Since all of the side doors are identical, they will all be numbered 19.

Figure 3:
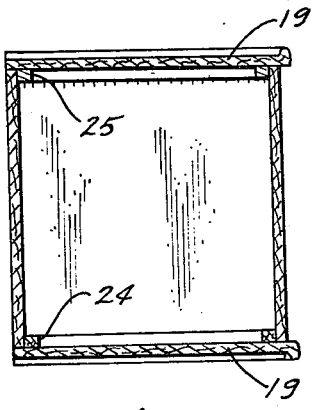
FIG. 3 is a cross-sectional view taken along line 3—3 of FIG. 2.

A third side opening 24 is shown in FIG. 3, and this third opening 24 is generally in alignment with opening 25 on the opposite side of the housing 12. Of course, these openings 24 and 25 also have doors 19 thereon for selectively opening or closing these openings. Additionally, a fifth opening 26 is provided intermediate the first opening 18 and the third opening 24; and, a sixth opening 27 is provided in the housing 12 intermediate the second opening 22 and the fourth opening 25. These openings 26 and 27 are also aligned so that a person can see completely through the housing 12 by looking through these openings. There are no doors on the openings 26 and 27 for reasons which will be explained below.

Figure 7:
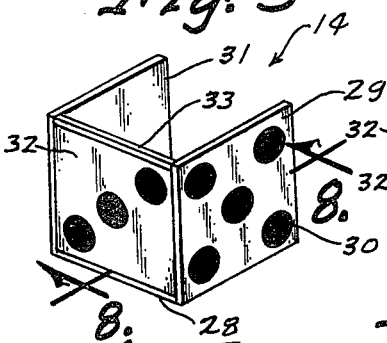
FIG. 7 is a perspective view showing a collapsible die constructed in accordance with the present invention in an uncollapsed position.
Figure 8:
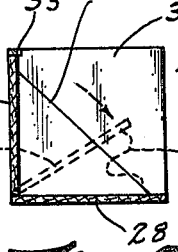
FIG. 8 is a cross-sectional view taken along line 8—8 of FIG. 7.
Figure 9:
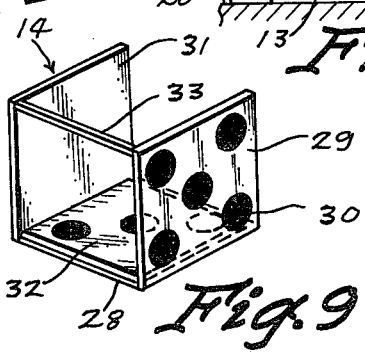
FIG. 9 is a perspective view like FIG. 7, but showing the die in a collapsed position.

Referring now to the die 14 shown in FIGS. 7–9, it is noted that there is a first member 28 which serves as the base for the die. Rigidly attached to one edge of the first member 28 is a second member 29 having a plurality of spots 30 painted thereon. A third member 31 having spots painted thereon is rigidly attached to the other side of the base member 28. A fourth member 32 having spots painted thereon is pivotally attached at the bottom end thereof to either the member 28 or to the side members 29 and 31, and this member 32 is movable from a vertically disposed position as shown in FIGS. 7 and 8 to a collapsed position as shown in FIG. 9. A member 33 is rigidly attached to corners of members 29 and 31 for the purpose of adding some rigidity to the die 14 and also for being in frictional contact with the top of the member 32 so as to hold it in the position shown in FIGS. 7 and 8 until such time as it is desired to move it to the FIG. 9 position. A thread 34 is attached to the top of the member 32 and to the back top side of member 28 for reasons which will be explained below.

Figure 2:
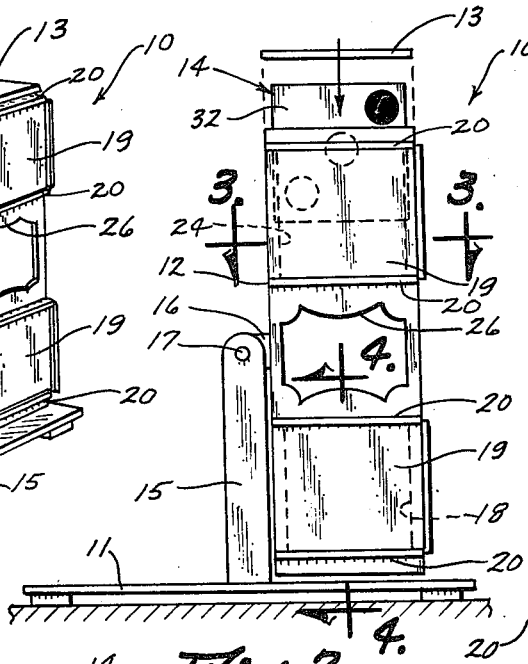
FIG. 2 is a side elevational view of the present invention showing a die being inserted into a housing.
Figure 6:
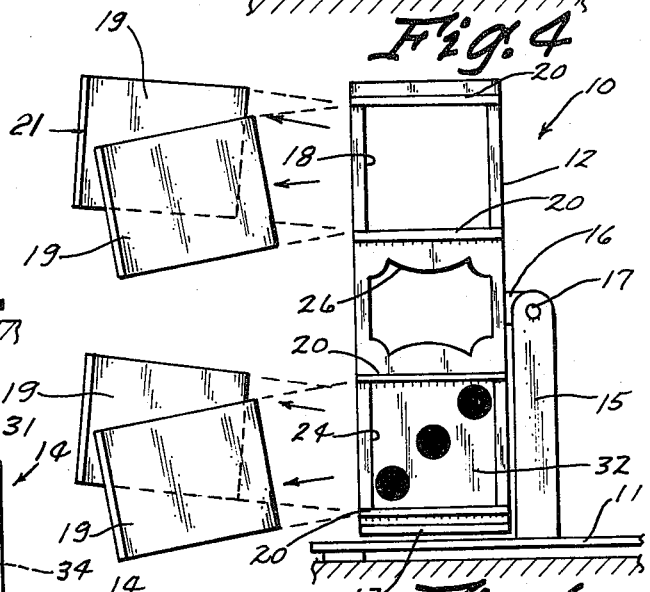
FIG. 6 is a side elevational view similar to FIG. 2, but showing the housing in its opposite position and illustrating that the doors are removable.

The operation of the present invention can best be explained by explaining briefly a typical performance using the present invention. Initially, the die 14 is shown to the audience in such a way that only the solid sides are shown, so that it appears to be a solid die having all sides present. The lid 13 is then removed and the die 14 is placed into the chamber 23 of the housing 12 as is illustrated in FIG. 2, and the lid 13 is then again attached to the housing 12. Of course, once the die 14 is inserted into the chamber 23 shown in FIG. 2, it will immediately slide past the intermediate openings 26 and 27 to the lowermost part of the chamber 23 so that the audience will be able to appreciate the fact that the die is in the housing 12 and has passed from the top part of the housing 12 to the bottom part thereof as viewed in FIG. 2. The entire housing 12 would then be pivoted from the position shown in FIG. 2 to the position shown in FIG. 6, but with all of the doors 19 in place. In moving from the FIG. 2 position to the FIG. 6 position, the die 14 will again pass the intermediate openings 26 and 27 so that the audience can know that the die is still in the housing 12 and they will, of course, know that the die has moved by gravity to the lower part of the housing 12 when it is in the position shown in FIG. 6 despite the fact that the doors 19 would be in place. This particular maneuver of pivoting the housing 12 back and forth between the postions of FIG. 2 and FIG. 6 can be performed as many times as desired in order to achieve whatever particular dramatic effect is desired by the magician performing this trick. Assume, however, that after several of these maneuvers that the device is in position as shown in FIG. 6, but with the doors 19 in place. At such time the magician would remove the top doors 19 showing the audience that the die is not in the top portion thereof because the audience would be able to see through openings 18 and 22, which openings would be on the top in FIG. 6. At such time the audience would naturally request that the lower openings 24 and 25 be exposed, since they believe the die to be in the bottom compartment. The magician would then return the top doors covering openings 18 and 22, flip the housing 12 back to the position in FIG. 2, and then expose the openings 24 and 25 by removing the doors 19 as just previously requested by the audience. The people in the audience, of course, want the lower doors removed when the device in in the position shown in FIG. 2, so that the magician, with the top doors 19 removed, proceeds to remove the door 19 from the back opening 22 so that only the door 19 covering the opening 18 remains on the housing 12. At such time, he then pushes on the thread 34 with his thumb or finger, thereby causing the front member 32 to pivot downwardly from the position shown in FIG. 7 to the position shown in FIG. 9, noting the dashed lines in FIG. 8 showing an intermediate position of the member 32 as it is so moving. Once the die 14 is in the position shown in FIG. 9, then the door 19 covering the opening 18 is removed and, to the amazement of the audience, the die 14 appears to have disappeared. In other words, the audience would see the housing 12, and would be able to see through the openings 24 and 25 on the top, through the openings 26 and 27 in the middle, and through the openings 18 and 22 on the bottom when they are viewing it in FIG. 2 after the trick is completed.

Obviously many modifications and variations of the present invention are possible in light of the above teachings. It is therefore to be understood that, within the scope of the appended claims, the invention may be practiced otherwise than as specifically described.

I claim:

1. Apparatus for creating an illusion comprising:

a housing;

means forming a chamber in said housing;

a first opening disposed in said housing leading from the exterior of said housing to said chamber for permitting visual access to said chamber;

door means for selectively opening or closing said first opening;

a second opening disposed in said housing leading from the exterior of said housing to said chamber, said second opening being substantially in alignment with the first said opening;

door means for selectively opening or closing said second opening;

a third opening disposed in said housing leading from the exterior of the housing to said chamber, the first said opening being adjacent one end of said housing and the third opening being adjacent the other end of the housing;

door means for selectively opening or closing said third opening;

a fourth opening disposed in said housing leading from the exterior of the housing to said chamber, said fourth opening being in alignment with said third opening; and, door means for selectively opening and closing said fourth opening;

a fifth opening disposed in said housing leading from the exterior of said housing to said chamber, said fifth opening being formed between the first said opening and the third opening;

a sixth opening leading from the exterior of said housing to said chamber, said sixth opening being in alignment with said fifth opening thereby forming a visual passageway through said housing;

means selectively receivable in said chamber for selectively creating the illusion of either a parallelepiped or an empty space comprising:

a first substantially flat member;

a second substantially flat member rigidly connected to said first flat member and disposed substantially normal to said first flat member;

a third substantially flat member rigidly connected to said first flat member and disposed substantially normal to said first flat member and substantially parallel to said second flat member;

a fourth substantially flat member; and means for pivotally attaching said fourth flat member adjacent to said first flat member whereby said fourth flat member is pivotally movable between a first position whereby said fourth flat member is normal to said first, second and third flat members, and a second position whereby said fourth member is substantially parallel to said first flat member and substantially normal to said second and third flat members;

means for frictionally holding said fourth member in said first position thereof;

means for inconspicuously moving said fourth flat member from the first to the second position thereof said moving means comprising a flexible line attached to said first and fourth members whereby pushing on said line when said fourth member is in the first position thereof causes it to be moved to the second position thereof;

a base member and means for pivotally attaching said housing to said base member whereby said housing is movable between a first position wherein said second opening is below said fourth opening and a second position wherein said second opening is above said fourth opening; and means for selectively opening or closing said other end of said housing.

2. The apparatus of claim 1 wherein the housing and the door means for the first, second, third and fourth openings are opaque.

* * * * *